US007597536B1

(12) United States Patent
Liang

(10) Patent No.: US 7,597,536 B1
(45) Date of Patent: Oct. 6, 2009

(54) TURBINE AIRFOIL WITH DE-COUPLED PLATFORM

(75) Inventor: George Liang, Palm City, FL (US)

(73) Assignee: Florida Turbine Technologies, Inc., Jupiter, FL (US)

( * ) Notice: Subject to any disclaimer, the term of this patent is extended or adjusted under 35 U.S.C. 154(b) by 341 days.

(21) Appl. No.: 11/453,429

(22) Filed: Jun. 14, 2006

(51) Int. Cl.
*F01D 5/08* (2006.01)

(52) U.S. Cl. ..... 415/138; 415/115; 416/97 R

(58) Field of Classification Search ..... 415/115, 415/138; 416/97 A, 97 R
See application file for complete search history.

(56) References Cited

U.S. PATENT DOCUMENTS 3,656,863 A * 4/1972 De Feo ..... 416/97 R
3,950,113 A * 4/1976 Albrecht ..... 416/97 A
4,293,275 A 10/1981 Kobayashi et al.
4,396,349 A * 8/1983 Hueber ..... 415/115
4,480,956 A * 11/1984 Kruger et al. ..... 416/97 A
4,501,053 A * 2/1985 Craig et al. ..... 416/97 R
4,863,348 A * 9/1989 Weinhold ..... 416/92
5,145,315 A * 9/1992 North et al. ..... 415/115
5,340,278 A 8/1994 Magowan
5,358,379 A * 10/1994 Pepperman et al. ..... 415/191
5,382,135 A 1/1995 Geen
6,017,189 A 1/2000 Judet et al.
6,341,939 B1 1/2002 Lee
6,416,284 B1 7/2002 Demers et al.
6,478,540 B2 11/2002 Abuaf et al.
6,758,651 B2 7/2004 Tomita et al.
6,830,427 B2 12/2004 Lafarge et al.
6,830,432 B1 12/2004 Scott et al.
7,004,720 B2 2/2006 Synnott et al.
7,021,896 B2 4/2006 Dodd
7,080,971 B2 * 7/2006 Wilson et al. ..... 416/92

* cited by examiner

*Primary Examiner*—Igor Kershteyn
(74) *Attorney, Agent, or Firm*—John Ryznic

(57) ABSTRACT

An airfoil used in a gas turbine engine, such as a turbine blade, includes a thin slot formed between a platform section and an airfoil section of the blade, with a metering hole providing for a cooling air passage between a dead rim cavity and the thin slot, such that cooling air passes through the thin slot and out onto the transition between the platform and airfoil for cooling purposes. A plurality of thin slots is arranged around the periphery of the airfoil on the platform of the blade and extends from the leading edge to the trailing edge. In another embodiment, one thin slot could extend from the around the pressure side and the suction side of the airfoil. The thin slot not only provides cooling air to the transition region of the blade, but also de-couples the platform from the airfoil of the blade to reduce stress levels due to thermal gradients.

6 Claims, 2 Drawing Sheets

TURBINE AIRFOIL WITH DE-COUPLED PLATFORM

CROSS-REFERENCE TO RELATED APPLICATIONS

None.

STATEMENT REGARDING FEDERALLY SPONSORED RESEARCH OR DEVELOPMENT

None.

BACKGROUND OF THE INVENTION

1. Field of the Invention

The present invention relates to airfoils used in a gas turbine airfoil, and more specifically to an airfoil having a platform.

2. Description of the Related Art Including Information Disclosed Under 37 CFR 1.97 and 1.98

In a gas turbine engine, a turbine section includes a plurality of turbine blades and guide nozzles or vanes on which a hot gas stream reacts to drive the turbine. This hot gas stream passes through and around the turbine blades. A hot gas migration phenomenon on the airfoil pressure side is created by a combination of hot flow core axial velocity and static pressure gradient exerting on the surfaces of the airfoil pressure wall and the suction wall of adjacent airfoils. As a result of this hot gas flow phenomena, some of the hot core gas flow from an upper airfoil span is transferred toward a close proximity of the platform and therefore creates a high heat transfer coefficient and high gas temperature region at approximately two-thirds of the blade chord location. FIG. 1 shows a cutaway view of the vortices formation for the hot glow gas migration across the turbine flow passage, and shows a hot spot on the platform of each blade on the pressure side 18.

A Prior Art blade with platform is shown in FIG. 2. The blade includes a root 10, a cooling fluid passage 12, a platform 14, an airfoil 18, and a tip 19. A fillet region 16 is formed between the airfoil and the platform. Cooling of a blade fillet region 16 by means of conventional backside convective cooling method yields inefficient results due to the thickness of the airfoil fillet region 16. On the other hand, drilling film holes 17 at the blade fillet to provide for film cooling produces unacceptable stress by the film cooling holes 17. A line of film cooling holes 17 along the lower section of the blade for cooling the blade fillet region 16 would be located in the region of the airfoil having the highest pull stress levels, thereby providing a point of weakness at the highest stress points on the blade.

U.S. Pat. No. 6,341,939 B1 issued to Lee on Jan. 29, 2002 entitled TANDEM COOLING TURBINE BLADE discloses a turbine blade with a central cooling air passage and a metering hole leading from the central passage and onto the outer surface of the platform around the transition region of the blade for cooling the transition region (space between the airfoil and the platform). However, the Lee invention does not uncouple the airfoil from the platform as does the present invention, among other differences.

U.S. Pat. No. 5,340,278 issued to Magowan on Aug. 23, 1994 entitled ROTOR BLADE WITH INTEGRAL PLATFORM AND A FILLET COOLING PASSAGE discloses a turbine blade with a cooling fluid passage connecting the core passage of the blade with the damper or dead rim cavity for the purpose of cooling the fillet of the platform and airfoil transition. No cooling air passes onto the outer surface of the airfoil platform or airfoil, and the platform is not uncoupled from the airfoil as in the present invention, among other differences.

U.S. Pat. No. 5,382,135 issued to Green on Jan. 17, 1995 entitled ROTOR BLADE WITH COOLED INTEGRAL PLATFORM shows a turbine blade with a platform having a plurality of cooling holes located on the pressure side of the blade for cooling the platform. A row of cooling holes closest to the airfoil surface are supplied with cooling air from the core or central passage of the blade, while an outer row of cooling holes are supplied with cooling air from the dead rim cavity below the platform. The Green invention does not provide for the uncoupling of the platform from the airfoil as in the present invention, among other differences.

One alternate way of cooling the fillet region is by the injection of film cooling air at discrete locations along the airfoil peripheral into the downward hot gas flow to create a film cooling layer for the fillet region 16. However, in order to achieve a high film effectiveness level, the discrete holes used in this type of film cooling injection have to be in a close pack formation. Otherwise, the spacing between the discrete film cooling holes and areas immediately downstream of the spacing are exposed to less cooling or no film cooling air at all. Consequently, these areas are more susceptible to thermal degradation and over temperature. On the other hand, the close pack cooling holes at the blade lower span becomes undesirable and the stress rupture capability of the blade is lower.

An object of the present invention is to reduce or eliminate the high heat transfer coefficient and high gas temperature region as well as high thermal gradient problem associated with a turbine blade platform.

Another object of the present invention is to uncouple the platform from the airfoil of the blade in order to reduce stress from thermal gradients between the two parts of the blade.

BRIEF SUMMARY OF THE INVENTION

An airfoil used in a gas turbine engine includes a root, a platform, and an airfoil extending from the root and platform. A continuous thin slot or a plurality of discrete thin slots is disposed around the airfoil periphery at the airfoil and platform intersection. This thin film cooling slot is constructed with the airfoil fillet extended below the boundary wall and submerged within the slot. The thin film cooling slot is wrapped around the airfoil pressure side and suction side, and then is merged together at the airfoil trailing edge forming a closed loop film slot.

Cooling air from a dead rim cavity is injected within the thin film slot at the aft ward end throughout the internal surface of the thin film slot to provide a film layer and cool the airfoil and platform junction. Since the film cooling slot is formed below the blade platform and at an increased volume to diffuse the cooling air, a better built-up of the film layer for the injected cooling air is formed. In addition, some of the diffused cooling air from both pressure and suction side slots are then joined together at the airfoil trailing edge location to provide additional film cooling for the airfoil trailing edge root section as well as the downstream high heat load wake region.

DETAILED DESCRIPTION OF THE INVENTION

Figure 1:
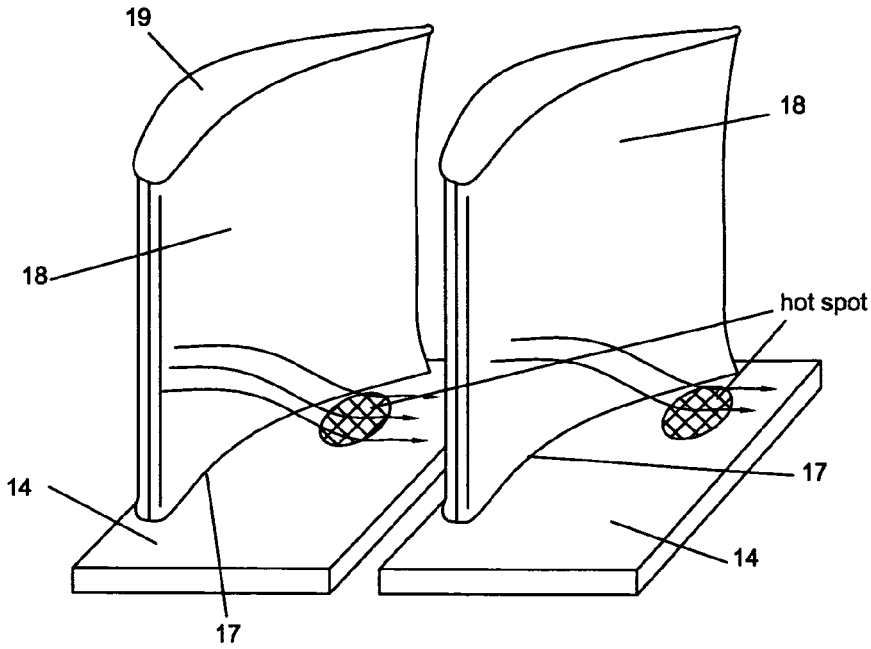
Fig 1 Prior Art
FIG. 1 shows a hot gas migration path across a turbine flow passage of the Prior Art.
Figure 2:
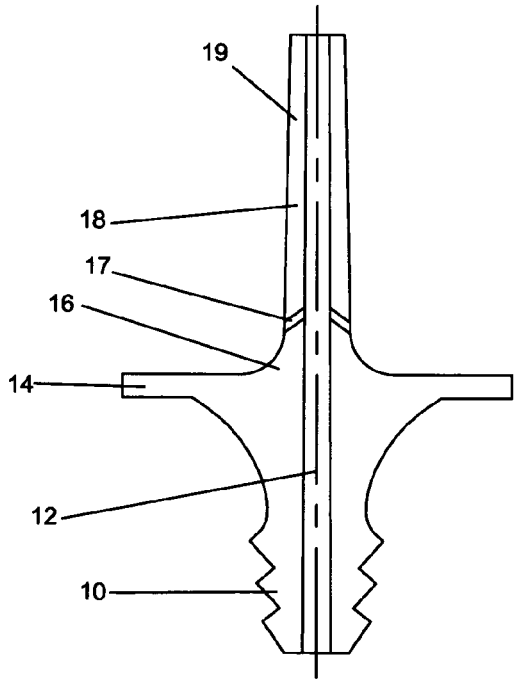
Fig 2 Prior Art
FIG. 2 shows cross section view of a Prior Art turbine blade with a fillet region formed at a platform and airfoil junction.
Figure 3:
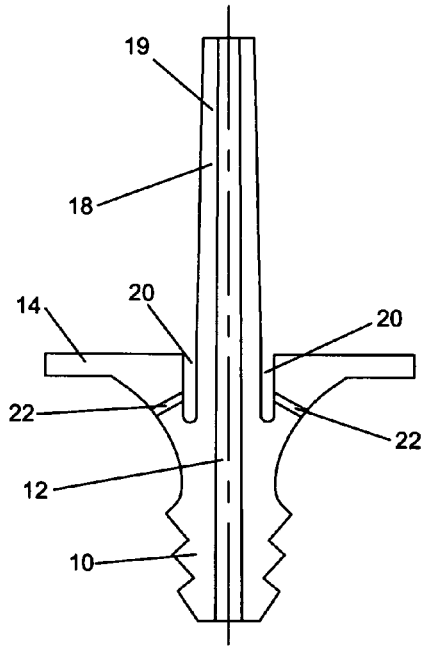
FIG. 3 shows cross section view of a turbine blade of the present invention.

A gas turbine engine has one or more stages of turbine blades arranged around a rotor disk. A turbine rotor disk includes a plurality of blades circumferentially arranged around the disk in which adjacent blades form a flow path for the hot gas stream passing through the turbine. Each turbine blade is represented in FIG. 3, and includes a root 10 with a fir tree configuration for insertion in a slot formed on the outer surface of the rotor disk, a core or central passageway 12 for a cooling fluid such as compressed air to pass through, a platform 14, an airfoil portion having a pressure side 18 and a suction side, and a tip 19. Instead of the fillet region 16 of the Prior Art turbine blade, the present invention provides for a thin slot 20. The slot 20 can be as thin as 0.25 mm and up to about 1 mm in thickness. The thickness of the thin slot 20 can be more than 1 mm. However, if the slot is wide enough, then the hot gas stream may ingest into the opening and dilute the cooling air. The width of the slot is wide enough to decouple the platform from the airfoil, yet not too wide to promote flow of the hot gas stream ingestion into the opening of the slot. A depth of the slot 20 into the blade root from about as thick as the platform 14 or about twice the thickness of the platform 14. The bottom of the slot 20 is rounded. A metering hole 22 fluidly connects the thin slot 20 to a dead rim cavity on the other side of the blade surface. The airfoil portion extends from the root at a point where the bottom of the thin slots is located. Each of the thin slots 20 can have one or more metering holes 22 to supply cooling fluid to the slots 20. The exit area of the slot 20 is from about 3 to about 5 times the size of the exit area of the metering hole 22.

Figure 4:
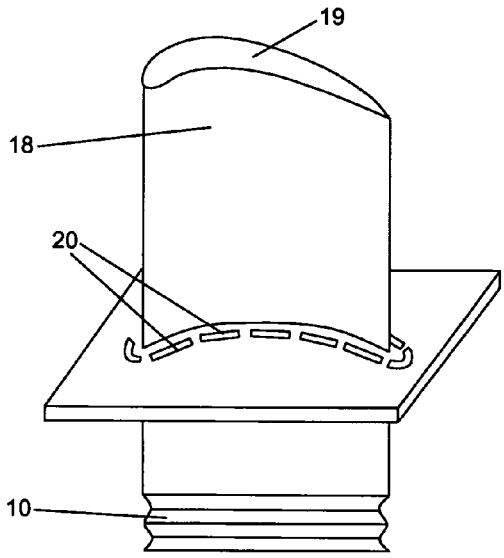
FIG. 4 shows a schematic view of a turbine blade of the present invention with a plurality of short slots.
Figure 5:
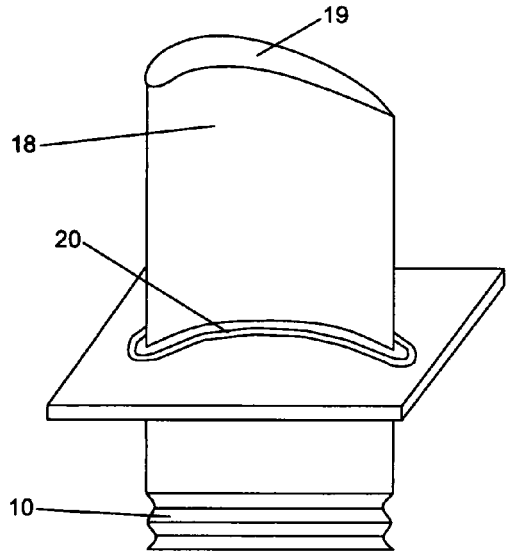
FIG. 5 shows a second embodiment of the turbine blade of the present invention with a single slot.

FIG. 4 shows a schematic view of the turbine blade of FIG. 3. A plurality of the thin slots 20 is disposed around the airfoil peripheral at the airfoil and platform intersection. The slots 20 are located on both the suction side and the pressure side 18 of the blade. FIG. 4 shows the slots 20 be a plurality of short slots arranged in series. However, the slot 20 could be one long slot arranged around the entire airfoil portion of the blade as shown in FIG. 5. Or, two slots—one on the pressure side and another on the suction side—of the blade, and either connected at the leading edge of the blade or not connected together.

To provide cooling of the blade platform 14, cooling air from the dead rim cavity passes through the plurality of metering holes 22, into the thin slots 20, and out the opening of the thin slots 20 and onto the airfoil and platform 14 for cooling purposes. The thin slot or slots 20 spaced around the platform de-couple the platform the from airfoil portion of the blade.

The thin slot and metering hole arrangement provides for several advantages over the Prior Art arrangement. Among these are: the thin metering film slot cooling arrangement provides for improved cooling along the airfoil root region and improved film formation relative to the Prior Art discrete film cooling hole injection technique; the metering cooling holes within the thin slot provide additional impingement convective cooling for the airfoil; the thin metering film cooling slots create additional local volume for the expansion of the cooling air, slows down the cooling velocity and pressure gradients (the cooling air will diffuse within the thin film cooling slot and thus build up a good film cooling layer for the airfoil platform hot spot region cooling); the thin metering film cooling slot increases the uniformity of the film cooling and insulates the airfoil from platform as well as the passing hot core gas, and thus establishes a durable film cooling for the platform region; the thin metering film cooling slot minimizes cooling loses or degradation of the film and therefore provides a more effective film cooling for film development and maintenance; the thin metering film cooling slot extends the cooling air continuously along the interface of the airfoil versus platform location, and therefore minimizes thermally induced stress by eliminating the discrete cooling hole which is separated by the non-cooled area characteristic of the Prior Art cooling scheme; the thin metering diffusion film cooling slots reduce the airfoil versus platform stiffness (especially for the airfoil trailing edge root section, the thin metering film cooling slot reduces the stiffness in the root local region and also provides local film cooling around the trailing edge root location and therefore greatly reduces the local metal temperature and improves the airfoil TMF or thermal mechanical fatigue capability); and, the thin lettering diffusion slot decouples the platform from the blade airfoil which functions as a strain isolator for the airfoil platform, minimizing the thermal mismatch between the blade airfoil and the platform and therefore reducing the thermal gradient and improves the platform TMF or thermal mechanical fatigue life.

I claim the following:

1. A turbine airfoil comprising:

a root;

an airfoil portion having a pressure side and a suction side;

a platform extending from the airfoil portion;

the root, the airfoil portion and the platform are a single piece;

a thin slot formed in the airfoil between the platform and the airfoil portion, the thin slot reducing a stiffness between the platform and the airfoil to uncouple the platform from the airfoil portion to reduce stresses due to thermal gradients, the thin slot opening onto the platform surface and having a bottom that does not pass through the platform;

a metering hole fluidly connecting the thin slot with a dead rim cavity formed below the platform for supplying a cooling fluid into the slot; and, a plurality of thin slots formed around the periphery of the airfoil on the pressure side and the suction side, each of the plurality of slots having a metering hole therein to supply a cooling fluid to the respective thin slot.

2. A turbine airfoil comprising:

a root;

an airfoil portion having a pressure side and a suction side;

a platform extending from the airfoil portion;

the root, the airfoil portion and the platform are a single piece; and, a thin slot formed in the airfoil between the platform and the airfoil portion, the thin slot reducing a stiffness between the platform and the airfoil to uncouple the platform from the airfoil portion to reduce stresses due to thermal gradients, the thin slot opening onto the platform surface and having a bottom that does not pass through the platform; and, the thin slot having a width of from about 0.25 mm to about 1 mm.

3. A turbine airfoil comprising:

a root;

an airfoil portion having a pressure side and a suction side;

a platform extending from the airfoil portion;

the root, the airfoil portion and the platform are a single piece; and, a thin slot formed in the airfoil between the platform and the airfoil portion, the thin slot reducing a stiffness between the platform and the airfoil to uncouple the platform from the airfoil portion to reduce stresses due to thermal gradients, the thin slot opening onto the platform surface and having a bottom that does not pass through the platform; and, the slot has a depth from about one to two times the thickness of the platform.

4. A turbine airfoil comprising:

a root;

an airfoil portion having a pressure side and a suction side;

a platform extending from the airfoil portion;

the root, the airfoil portion and the platform are a single piece;

a thin slot formed in the airfoil between the platform and the airfoil portion, the thin slot reducing a stiffness between the platform and the airfoil to uncouple the platform from the airfoil portion to reduce stresses due to thermal gradients, the thin slot opening onto the platform surface and having a bottom that does not pass through the platform;

a metering hole fluidly connecting the thin slot with a dead rim cavity formed below the platform for supplying a cooling fluid into the slot; and, an exit area of the slot is from about 3 to 5 times the size of the exit area of the metering hole.

5. A turbine airfoil comprising:

a root;

an airfoil portion having a pressure side and a suction side;

a platform extending from the airfoil portion;

the root, the airfoil portion and the platform are a single piece; and, a thin slot formed in the airfoil between the platform and the airfoil portion, the thin slot reducing a stiffness between the platform and the airfoil to uncouple the platform from the airfoil portion to reduce stresses due to thermal gradients, the thin slot opening onto the platform surface and having a bottom that does not pass through the platform; and, a row of separated thin slots extending along the platform from the leading edge to the trailing edge, each separated thin slot having a metering hole fluidly connecting the thin slot with a dead rim cavity formed below the platform for supplying a cooling fluid into the thin slot.

6. A turbine airfoil comprising:

a root;

an airfoil portion having a pressure side and a suction side;

a platform extending from the airfoil portion;

the root, the airfoil portion and the platform are a single piece; and, a thin slot formed in the airfoil between the platform and the airfoil portion, the thin slot reducing a stiffness between the platform and the airfoil to uncouple the platform from the airfoil portion to reduce stresses due to thermal gradients, the thin slot opening onto the platform surface and having a bottom that does not pass through the platform;

the slot is a thin continuous slot that extends along the platform surface from the leading edge to the trailing edge; and, a plurality of metering holes fluidly connecting the thin continuous slot with a dead rim cavity formed below the platform for supplying a cooling fluid into the slot.

* * * * *